US005281774A

United States Patent [19]

Masaki

[11] Patent Number: 5,281,774

[45] Date of Patent: Jan. 25, 1994

[54] DRIVE CONTROL UNIT FOR HYDRAULIC ELEVATOR

[75] Inventor: Takanobu Masaki, Inazawa, Japan

[73] Assignee: Mitsubishi Denki Kabushiki Kaisha, Tokyo, Japan

[21] Appl. No.: 794,904

[22] Filed: Nov. 20, 1991

[30] Foreign Application Priority Data

Nov. 20, 1990 [JP] Japan ..... 2-312680

[51] Int. Cl.[5] ..... B66B 1/04; B66B 1/28

[52] U.S. Cl. ..... 187/110; 187/111

[58] Field of Search ..... 187/110, 111, 113, 115, 187/116, 118, 29.2; 318/162, 163, 481

[56] References Cited

U.S. PATENT DOCUMENTS

| | | | |
|---|---|---|---|
| 4,351,415 | 9/1982 | Kita | 187/29.2 |
| 4,593,792 | 6/1986 | Yamamoto | 187/29.2 |
| 4,686,439 | 8/1987 | Cunningham et al. | 318/335 |
| 4,976,338 | 12/1990 | Holland | 187/110 |

FOREIGN PATENT DOCUMENTS

| | | | |
|---|---|---|---|
| 0064311 | 1/1989 | Japan | B66B 1/26 |
| 0066083 | 3/1990 | Japan | 187/111 |
| 0023169 | 1/1991 | Japan | 187/110 |
| 0111385 | 5/1991 | Japan | 187/111 |
| 0267279 | 11/1991 | Japan | 187/110 |
| 0153173 | 5/1992 | Japan | 187/111 |
| 0189273 | 7/1992 | Japan | 187/110 |
| 0213576 | 8/1992 | Japan | 187/111 |
| 2243927 | 11/1991 | United Kingdom | 187/111 |

*Primary Examiner*—Steven L. Stephan
*Assistant Examiner*—Thomas M. Dougherty
*Attorney, Agent, or Firm*—Leydig, Voit & Mayer

[57] ABSTRACT

A drive control unit for a hydraulic elevator comprises: an inverter for variably driving the motor; a speed detector for detecting a rotating speed of the motor; a current detector for detecting a primary current of the motor; a speed control, unit for calculating a torque command value to the motor according to a deviation between the rotating speed detected by the speed detector and a speed command value; a torque control unit for controlling the inverter according to the rotating speed detected by the speed detector, the primary current detected by the current detector and the torque command value calculated by the speed control unit; a pump pressure detector for detecting the pump pressure of the hydraulic pump; a limiting means for limiting the torque command value output from the speed control unit when the pump pressure, detected by the pump-pressure detector, decreases below a set value.

3 Claims, 2 Drawing Sheets

DRIVE CONTROL UNIT FOR HYDRAULIC ELEVATOR

BACKGROUND OF THE INVENTION

1. Field of the Invention

The present invention relates to a drive control unit for a hydraulic elevator which makes a cage ascend and descend by a hydraulic pump at a variable speed and particularly to a drive control unit which prevents negative pressure from the hydraulic pump from occurring at the time of a descending operation.

2. Description of the Related Art

In a conventional hydraulic elevator in which a cage is made to ascend and descend by using a hydraulic jack, a speed of the cage is controlled in such a manner that an electric motor is driven at a fixed rotating speed at the time of an ascending operation and an amount of oil provided to the hydraulic jack, from a fixed amount of oil sucked from an oil tank and emitted from the hydraulic pump, is adjusted by a flow controlling valve. At the time of a descending operation, the speed of the cage is controlled in such a manner that an amount of oil, which has been forced back from the hydraulic jack to the oil tank, is adjusted by the flow controlling valve.

However, in such a control method, since an excess amount of oil which is not provided to the hydraulic jack drives back from the hydraulic pump to the oil tank at the time of the ascending operation, a great loss of energy occurs. At the time of descending operation, since potential energy is converted to heat, this method is ineffective and the oil temperature rises greatly.

It has been proposed to control variably the amount of oil emitted from the hydraulic pump in such a manner that an induction motor is controlled at a variable voltage and a variable frequency (hereinafter called VVVF) by using an inverter or the like and the hydraulic pump is driven by the induction motor, as shown in Japanese Patent Publication No. 64-311.

In accordance with the controlling method using such an inverter, since a required amount of oil corresponding to a speed command value is provided to the hydraulic jack during ascent and the induction motor is regeneratively driven by the amount of oil which has forced back to the oil tank during descent so that energy consumption is reduced, the rising oil temperature is controlled, and thus an efficient drive control unit for a hydraulic elevator can be provided.

FIG. 2 shows a construction of a conventional drive control unit for a hydraulic elevator in which an amount of oil emitted from the hydraulic pump is variably controlled by the VVVF control.

Referring now to FIG. 2, a cylinder 1 is provided in a pit of a hoistway of the elevator, pressure oil 2 is filled in the cylinder 1, and a plunger 3 is supported by the pressure oil 2 and is driven up and down. The hydraulic jack consists of the above members.

In FIG. 2, a deflector sheave 4 is rotatively provided at the top of the plunger 3; the end of a cable 5 is secured to the pit and the center portion thereof passes around the deflector sheave 4; and a cage 6, fastened to the other end of the cable 5, is driven up and down.

A solenoid-operated valve 7 is provided with an oil pipe connected to the cylinder 1 which closes when the cage 6 stops as shown in FIG. 2. When the elevator starts, the valve 7 is opened by energization of an electromagnetic coil to clear a passage to the hydraulic jack.

A hydraulic pump 9 is variably driven so that it sends and receives the pressure oil to and from the solenoid-operated valve 7. An oil tank 12 sends and receives the pressure oil to and from the hydraulic pump 9. A three-phase induction motor 14 drives the hydraulic pump 9. An inverter 15 drives the induction motor 14 by the VVVF control. Connected to the inverter 15 is a three-phase AC power source 16. A converter 17 converts AC voltage from the three-phase AC power source 16 to DC voltage. A smoothing capacitor 18 smooths DC voltage output from the converter 17 and applies it to the inverter 15. A regeneration resistor 19 consumes power regenerated from the inverter 15. A regeneration transistor 20 is energized when the inverter 15 is regenerated.

A speed detector 21 detects the rotating speed S of the induction motor 14. A pattern generator 22 outputs a speed command value Q corresponding to ascending and descending drive patterns. A speed control unit 23 transmits a torque command value T to the induction motor 14 in accordance with the deviation between the speed command value Q and the rotating speed S. A current detector 24 detects a primary current I flowing to the induction motor 14. A torque control unit 25 controls the inverter 21 according to the torque command value T, the rotating speed S and the primary current I.

An operation of a conventional drive control unit of a hydraulic elevator is shown in FIG. 2.

During ascent of the cage 6, the positive-polarity speed command value Q is input into the speed control unit 23 which generates the torque command value T according to the deviation between the speed command value Q and the actual rotating speed S of the induction motor 14.

The torque control unit 25 controls the inverter 15 according to the rotating speed S of the induction motor 14, the primary current I and the torque command value T. The torque control unit 25 drives the induction motor 14 by means of the VVVF control corresponding to the torque command value T. The hydraulic pump 9 raises an emitting hydraulic (pump) pressure to provide the pressure oil 2 to the cylinder 1. Thus the cage 6 ascends at a speed corresponding to the speed command value Q.

On the other hand, during descent, the negative-polarity speed command value Q is input into the speed control unit 23 which generates a reversed-polarity torque command value T according to the deviation between the speed command value Q and the rotating speed S, in contrast to the torque command value during ascent.

The induction motor 14 is driven by the VVVF control corresponding to the reversed-polarity torque command value T. The hydraulic pump 9 reduces the emitting hydraulic pressure to drive back the pressure oil in the cylinder 1 to the oil tank 12. Thus the cage 6 descends at a speed according to the speed command value Q.

The speed of the cage 6 can be controlled by variably controlling the amount of oil emitted from the hydraulic pump 9.

In contrast to the operation of the flow control valve, the solenoid-operated valve 7 provided between the hydraulic pump 9 and the cylinder 1 of the hydraulic jack has only a function of opening and closing the pressure oil passage when the elevator is started and stopped. Accordingly, the amount of the opening of the solenoid-operated valve 7 is preset in order that the valve's internal pressure loss is sufficiently minimized.

If the elevator is operated when the solenoid-operated valve 7 is defectively opened by some failure of a part and a pressure loss in the valve 7 is great, the speed control unit 23 generates the larger torque command value T by the pressure loss of the solenoid-operated valve 7 than usual in order to make an actual speed S follow the speed command value Q. As a result, the hydraulic pressure emitted from the hydraulic pump 9 becomes abnormally high during ascent and abnormally low during descent. Since the pump pressure, which decreases during descent, often becomes negative, a failure may occur in the hydraulic pump 9 causing very dangerous condition due to air mixed in the oil pipes. Measures have been taken against the abnormally high pressure of oil of the hydraulic pump 9 which may be generated during ascent. For example, the operation of a relief valve can minimize the effects of failure of certain parts. However, no measures have been taken against abnormally negative pressures of the hydraulic pump 9 which may be generated during descent.

A torque limiter may be provided to the output portion of the speed control unit 23. However, a limiting value of the torque command value T must be set higher than a value within which the ascent can be performed at a predetermined acceleration even with a heavy load. This limiting value cannot absolutely prevent a negative value of the hydraulic pump 9 caused by some failure of the opening of the solenoid-operated valve 7.

In the conventional drive control unit of the hydraulic elevator as described above, no measures have been taken against abnormally negative pressure which may occur in the hydraulic pump 9 due to the failure of the opening of the solenoid-operated valve 7 during descent, which cause a failure to occur in the hydraulic pump and an air to be mixed in the oil pipes.

SUMMARY OF THE INVENTION

The present invention has been achieved to solve the above-described problems. An object of the present invention is to provide a drive control unit for the hydraulic elevator which can prevent an abnormally negative pressure which may occur during descent.

According to the present invention, the drive control unit for a hydraulic elevator in which an amount of the oil fed from a hydraulic pump to a hydraulic jack is adjusted by variably operating the motor directly connected to the hydraulic pump to control a speed of a cage, comprises: an inverter for variably driving the motor; a speed detector for detecting a rotating speed of the motor; a current detector for detecting a primary current of the motor; a speed control unit for calculating a torque command value to the motor according to a deviation between the rotating speed detected by the speed detector and a speed command value; a torque control unit for controlling the inverter according to the rotating speed detected by the speed detector, the primary current detected by the current detector and the torque command value calculated by the speed control unit; a pump pressure detector for detecting the pump pressure of the hydraulic pump; a limiting means for limiting the torque command value output from the speed control unit when the pump pressure, detected by the pump pressure detector, decreases below a set value.

DESCRIPTION OF THE PREFERRED EMBODIMENTS

Figure 1:
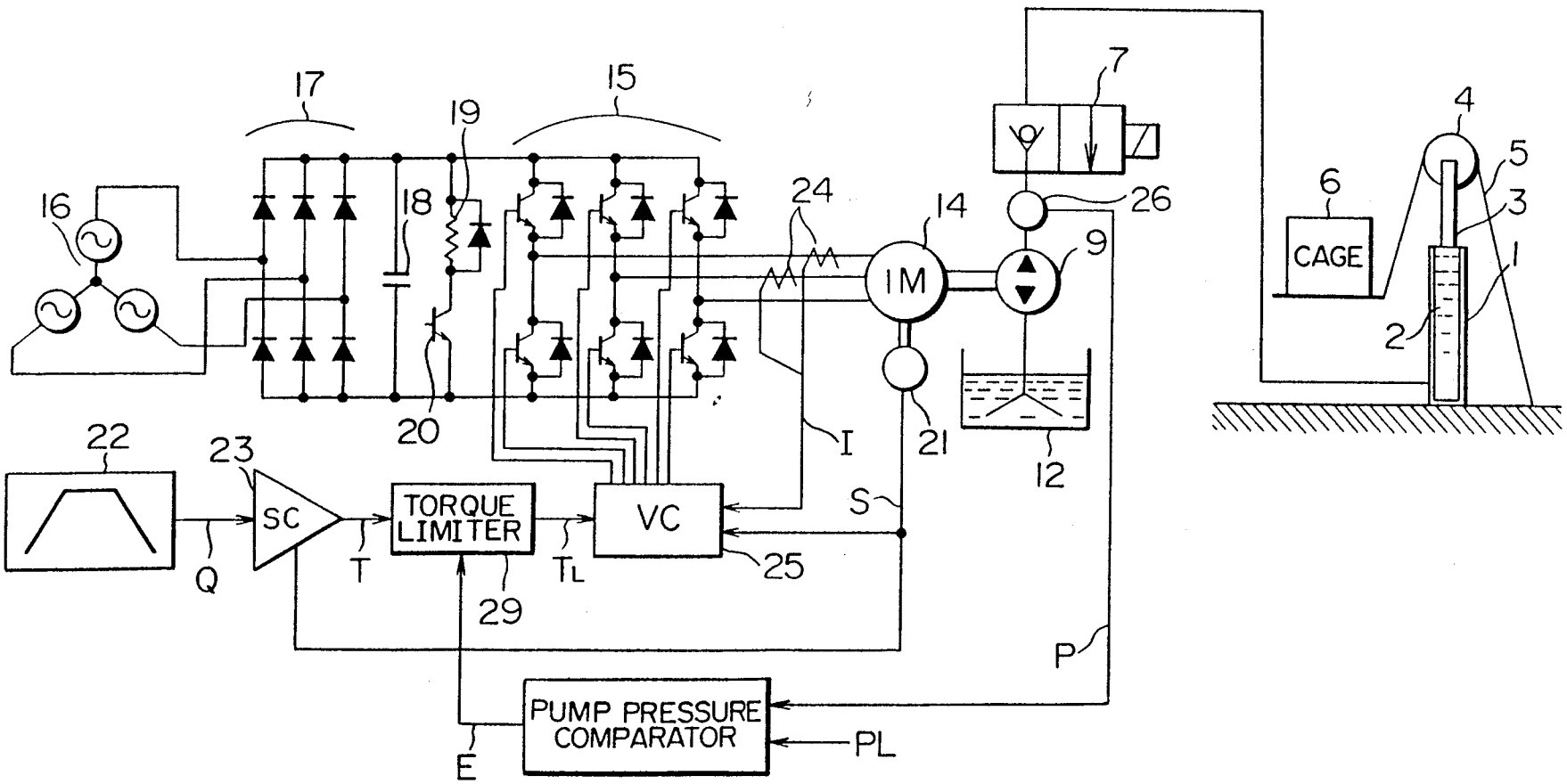
FIG. 1 is a block diagram showing the drive control unit for the hydraulic elevator in accordance with one embodiment of the present invention.
Figure 2:
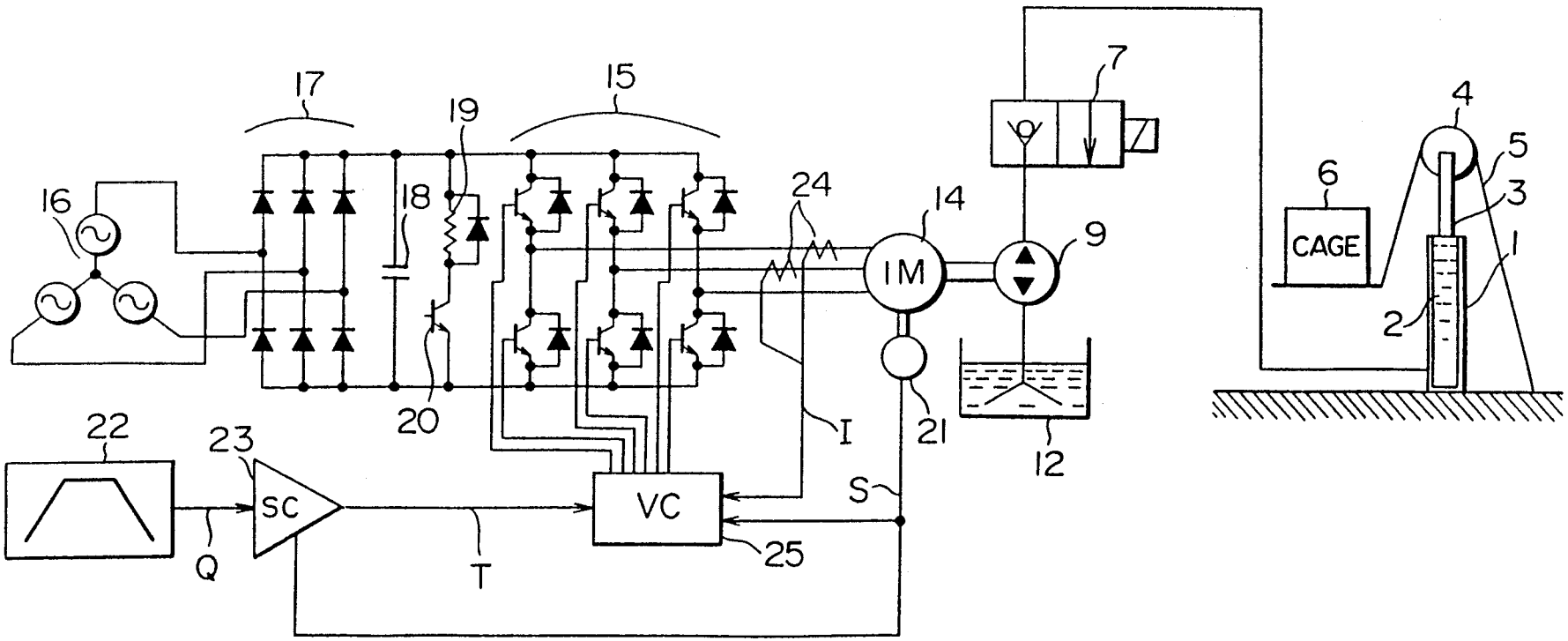
FIG. 2 PRIOR ART
FIG. 2 is a block diagram showing the conventional drive control unit.

One embodiment of the present invention will be described below with reference to the accompanying drawing. FIG. 1 shows the construction of an embodiment of the present invention. The members 1 to 25 in FIG. 1 are the same as the corresponding members of the conventional unit in FIG. 2 indicated by the same reference numbers.

A pump pressure detector 26, which detects the pump pressure P of a hydraulic pump 9, consists of a pressure sensor positioned between the hydraulic pump 9 and a solenoid-operated valve 7.

A pump pressure comparator 28, which compares the pump pressure P with a lower limit PL, outputs an abnormal signal E when a pump pressure P decreases below the lower limit PL. The lower limit PL is preset in consideration of an operational characteristic of the hydraulic pump.

A torque limiter 29, positioned between a speed control unit 23 and a torque control unit 25, limits a torque command value T to a predetermined value $T_L$ according to the abnormal value E.

An operation of an embodiment of the present invention shown in FIG. 1 will now be described.

If the solenoid-operated valve 7 is insufficiently opened due to some failure of a part when the elevator is started in the descending direction, the solenoid-operated valve 7 experiences a great pressure loss.

The negative-polarity speed command value Q from a pattern generator 22 is applied to the speed control unit 23 after an electromagnetic coil of the solenoid-operated valve 7 has been energized according to a starting command not shown. The speed control unit 23 generates the torque command value T according to the deviation between this negative-polarity speed command value Q and the rotating speed S detected by the speed detector 21 and inputs the torque command value T into the torque control unit 25 through the torque limiter 29. Since the abnormal signal E is not output from the pump pressure comparator 28 at this time, the torque command value T is not limited.

The torque control unit 25 controls the inverter 15 according to the torque command value T operated by the speed control unit 23 and gradually lowers the torque generated from the induction motor 14. With the decrease of the torque of the induction motor 14, the rotating speed S of the hydraulic pump 9 starts to decrease and the hydraulic pressure in the output pipes connected to the hydraulic pump 9 is gradually decreased.

Consequently, the pressure oil 2 in the cylinder 1 starts to be forced back to the hydraulic tank 12 through the solenoid-operated valve 7 and the hydraulic pump 9. Thus the cage 6 starts to descend.

For a short while after the elevator has started, since the hydraulic pressure in the output pipes connected to the hydraulic pump 9 is comparatively high and the pump pressure P does not reach the lower limit PL, the abnormal signal E is not output from the pump pressure comparator 28 and the torque limiter 29 does not set a limit to the torque command value T.

As the speed command value Q comes near the rated speed value and the amount of oil passed through the solenoid-operated valve 7 is increased, a value of a great pressure loss due to abnormal opening of the solenoid-operated valve 7 starts to influence the elevator.

At this time, the speed control unit 23 outputs the torque command value T higher than usual in order to make the actual rotating speed follow the speed command value Q. The hydraulic pressure in the output pipes connected to the hydraulic pump 9 therefore abnormally decreases.

When the pump pressure P finally reaches the lower limit PL, the abnormal signal E is generated by the pump pressure comparator 28 and the torque limiter 29 is operated by this abnormal signal E. The torque command value T is limited to the predetermined value $T_L$ at the same time that the torque limiter 29 starts to operate. The torque control unit 25 drives the inverter 15 to control the torque generated from the induction motor 14 according to the limited torque command value $T_L$.

As a result, the descending acceleration of the cage 6 is gradually decreased and the cage 6 descends at a constant speed in order that the torque generated from the induction motor 14 can be balanced by the load torque. As long as the pump pressure comparator 28 continues to output the abnormal signal E, the torque generated from the induction motor 14 continues to be limited. Therefore, the pump pressure P is maintained at a level which is lower than the lower limit PL by the amount of the pressure required for the acceleration of the cage 6, so that the generation of the negative pressure by the hydraulic pump 9 is prevented.

What is claimed is:

1. A drive control unit for a hydraulic elevator in which an amount of oil fed from a hydraulic pump to a hydraulic jack is adjusted by variably operating a motor directly connected to the hydraulic pump to control a speed of a cage, comprising:

an inverter for variably driving the motor;

a speed detector for detecting a rotating speed of the motor;

a current detector connected to said inverter for detecting a primary current of the motor;

a speed control unit connected to said speed detector for calculating a torque command value for the motor according to a deviation between the rotating speed detected by said speed detector and a speed detector and a speed command value;

a pump pressure detector for detecting the pump pressure of the hydraulic pump;

a limiting means for comparing the detected pump pressure with a set value and for limiting the torque command value output from said speed control unit when the pump pressure, detected by said pump pressure detector decreases below the set value said limiting means being electrically connected to said speed control unit and said pump pressure detector; and a torque control unit connected to said current detector, said speed controller and said speed detector such that said torque control unit controls said inverter according to the rotating speed detected by said speed detector, the primary current detected by said current detector and the torque command value calculated by said speed control unit.

2. A drive control unit as claimed in claim 1 wherein said limiting means includes:

a comparator for outputting an abnormal signal when the pump pressure, detected by said pump pressure detector, decreases below a set value; and a torque limiter for limiting the torque command value output from said speed control unit when an abnormal signal is output from said comparator.

3. A drive control unit as claimed in claim 2 wherein said torque limiter has a predetermined torque limiting value which prevents the pump pressure of the hydraulic pump from becoming a negative pressure, said torque limiter outputting the torque limiting value, instead of the torque command value output from said speed control unit, into said torque control unit when an abnormal signal is output from said comparator.

* * * * *